US006520331B2

(12) United States Patent
Okin et al.

(10) Patent No.: US 6,520,331 B2
(45) Date of Patent: Feb. 18, 2003

(54) TOWELETTE DISPENSING ARTICLE

(75) Inventors: Matthew Scott Okin, Cresskill, NJ (US); Raymond Michael Flaig, Stamford, CT (US)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/847,836

(22) Filed: May 2, 2001

(65) Prior Publication Data

US 2002/0162765 A1 Nov. 7, 2002

(51) Int. Cl.[7] ..... B65D 73/00

(52) U.S. Cl. ..... 206/494; 206/233; 206/812; 220/835; 220/839; 221/48

(58) Field of Search ..... 206/494, 812, 206/233, 210, 205, 499, 1.5; 220/837, 839, 835, 326, 4.23; 222/63; 221/44–46, 48, 61

(56) References Cited

U.S. PATENT DOCUMENTS 3,651,983 A * 3/1972 Haugen ..... 206/815
3,836,044 A * 9/1974 Tilp et al. ..... 206/205
4,314,651 A * 2/1982 Gaiser et al. ..... 220/210
4,730,731 A * 3/1988 Allison ..... 206/1.5
4,890,742 A * 1/1990 Allison ..... 206/1.5
4,925,041 A * 5/1990 Pehr ..... 215/216
5,050,737 A * 9/1991 Joslyn et al. ..... 206/494
5,785,179 A * 7/1998 Buczwinski et al. ..... 206/1.5
5,996,797 A * 12/1999 Flaig ..... 206/210
6,269,969 B1 * 8/2001 Huang et al. ..... 206/1.5

* cited by examiner

*Primary Examiner*—Mickey Yu
*Assistant Examiner*—Jila M Mohandesi
(74) *Attorney, Agent, or Firm*—Milton L. Honig

(57) ABSTRACT

A dispensing article, particularly for dispensing towelettes, is provided and includes a container body for storing the towelettes and a lid hingedly attached to the body. The container is formed from a floor panel, left and right side panels, front and rear panels. A button flap unitarily formed with the front wall includes a button projecting outwardly from a surface thereof. The lid includes a latch flap unitarily formed therewith and projecting downward toward the container body. An aperture is formed in the latch flap shaped to receive the button. Latch and button flaps are more flexible than other sections of the lid and container body panels. This flexibility allows for an easy to use, relatively inexpensive locking mechanism and provides good sealing characteristics. A refill canister can be placed within the container body.

16 Claims, 1 Drawing Sheet

TOWELETTE DISPENSING ARTICLE

BACKGROUND OF THE INVENTION

1. Field of the Invention

The invention concerns a resealable container for dispensing chemically impregnated towelettes.

2. The Related Art

Chemically impregnated pads, sheets and tissues (collectively defined as towelettes) are established articles of commerce. They are generally utilized for personal hygiene, cosmetic purposes and household cleaning applications. Fluid impregnated wipes require packaging which avoid evaporation of solvents. Dry towelettes impregnated with dry chemical coatings (e.g. surfactant compositions) require exclusion of atmospheric moisture during storage periods. Problems arise where a stack of impregnated towelettes are packed together in a common container. Dispensing of a single item requires resealability of the container to prevent the items from either drying out or absorbing unwanted moisture.

Accordingly, it is an object of the present invention to provide a towelette dispenser which can maintain a stack of towelettes sealed from the atmosphere during extended storage periods, especially after multiple openings for dispensing of individual tissues.

SUMMARY OF THE INVENTION

A dispensing article, particularly for towelettes, is provided which includes:

- a container body having a floor panel, left and right side panels opposite one another arising from the floor panel, front and rear panels opposite one another arising from the floor panel, an open mouth defined by upper edges of the front, rear and side panels, a button flap unitarily formed with the front panel, and a button projecting outwardly from a surface of the button flap;
- a lid having a roof panel hingedly joined to the container body, and a latch flap unitarily formed with and projecting downward from the roof panel;
- wherein the latch flap includes an aperture shaped to receive the button therein, the latch and button flaps being more flexible than other sections of the lid and container panels.

Further, the invention provides a towelette dispensing article which includes:

- a stack of towelettes;
- a container body receiving the towelettes and having a floor panel, left and right side panels opposite one another arising from the floor panel, front and rear panels opposite one another arising from the floor panel, an open mouth defined by upper edges of the front, rear and side panels, a button flap unitarily formed with the front panel, and a button projecting outwardly from a surface of the button flap;
- a lid having a roof panel hingedly joined to the container body, and a latch flap unitarily formed with and projecting downward from the roof panel;
- wherein the latch flap includes an aperture shaped to receive the button therein, the latch and button flaps being more flexible than other sections of the lid and container panels.

Advantageously the container front panel and button flap will have a relative thickness ranging from less than about 4:1 to more than about 1:1. Particularly preferred is a relative thickness ratio from about 3:1 to about 1.5:1. Those thinner areas represented by the button flap allow for resilient movement for sealing between the latch flap and button. A similar relative thickness relationship is preferred for the lid and latch flap.

Aperture and button may have any shape. Round shapes are preferred and an oval is particularly optimum.

Materials suitable for construction of the dispensing article include plastics such as polyolefins, polyesters and polyamides. Preferred are polypropylene and polyethylene, with the former most useful.

Along the upper edge of the panels defining the open mouth is a sealing band unitarily formed with the panels and of a thickness comparable to the button flap. In a similar arrangement, a lid band is unitarily formed with the panels of the lid. The lid band has a thickness comparable to that of the latch flap and extends along a periphery of the roof panel.

Insertable within the dispensing article is a refill canister. Walls of the canister are thinner than the panels of the container by a factor of about 2 or greater. While the container and lid are preferably produced through injection molding, the refill canister is produced by a thermoform process. Polyolefins are the plastic of choice for the refill canister.

Advantageously the floor panel of the container body includes a transparent window to allow viewing of a label on an outer bottom surface of the refill canister. There also may be a transparent window within the roof panel of the lid for observation of contents within the dispensing article.

BRIEF DESCRIPTION OF THE DRAWING

Further objects, features and advantages of the present invention will become more evident from consideration of the following drawing in which.

DETAILED DESCRIPTION OF THE INVENTION

Now it has been found that a refillable towelette dispenser can be provided with an economical yet effective seal arrangement. Vapor transfer is controllable to a high degree by the present configuration.

Figure 1:
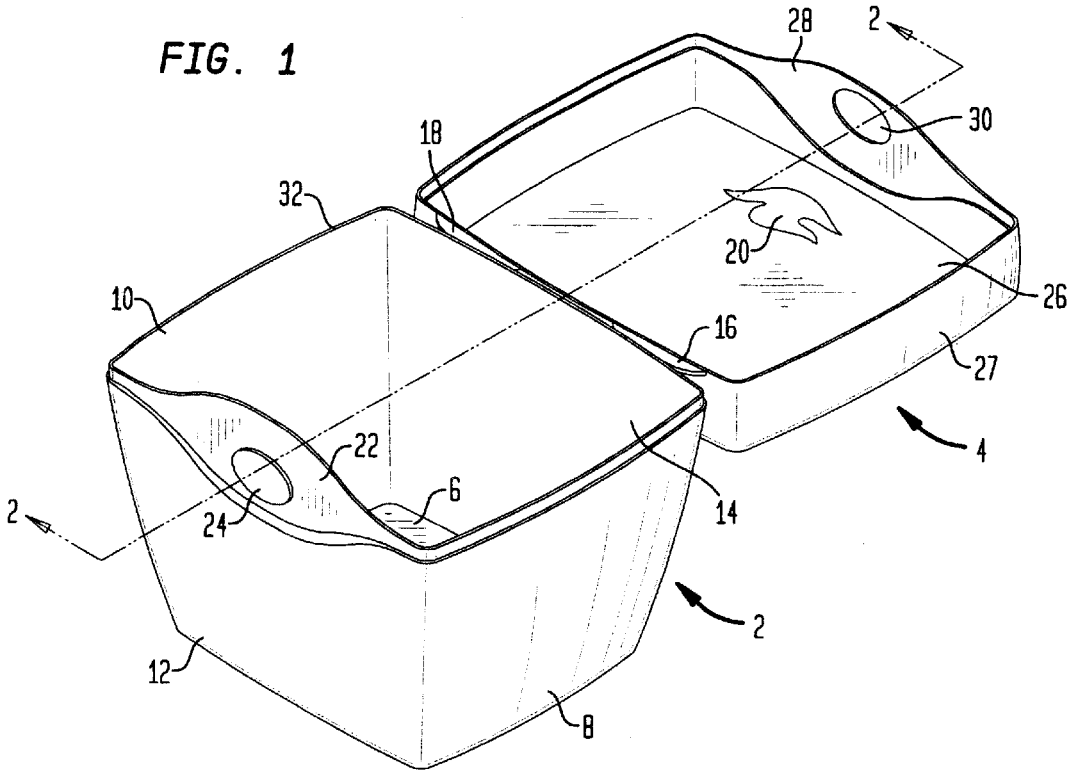
FIG. 1 is a plan perspective view of the dispensing article with lid in the open position and without a refill canister insert.
Figure 2:
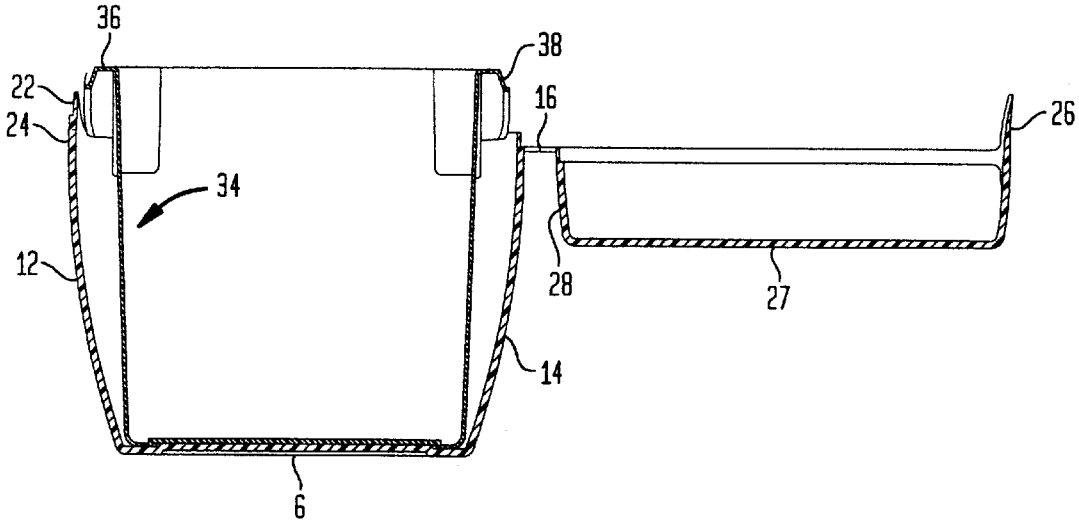
FIG. 2 is a cross-sectional view taken along line 2—2 of FIG. 1 except that a refill canister is shown.

FIG. 1 illustrates the dispensing article in an open position. The article includes a container body 2 and a lid 4 hingedly attached to the body. The container body has a floor panel 6, left side panel 8, right side panel 10, front panel 12 and rear panel 14. The left and right side panels are opposite one another and rise from the floor panel. Likewise, front and rear panels are opposite one another also rising from the floor panel.

Lid 4 is connected to rear panel 14 by a left and right hinge 16, 18. Lid, hinges and container body are all unitarily formed from a single piece molding process. No assembly of separate parts is necessary for the article. All areas of the lid except for a logo window 20 are frosted to an opaque or at least translucent format. The logo window is irregularly shaped and transparent. Transparency allows viewing of contents within the container body for purposes of establishing whether a new refill is required.

Button flap 22 is unitarily formed as an extension of the front panel 12. Lateral movement is achieved through the relatively thin gauge of the button flap compared to adjacent areas of the front panel. An approximately 3:1 thickness ratio is found between the adjacent front wall panel areas and the button flap.

A button 24 projects outwardly from a surface of the button flap.

The lid includes a roof panel 26 bordered by a skirt 27. A latch flap 28 is unitarily formed with and projects downward from the lid. Relative thicknesses for the roof panel or skirt to the latch flap is approximately 3:1, respectively. In fact, the thickness of latch and button flaps are substantially the same in the preferred embodiment.

An aperture 30 is formed within the latch flap shaped to receive the button.

A sealing band 32 is unitarily formed with all panels of the container and extends along an upper edge of those panels defining an open mouth of the container. Similar to the flaps, the sealing band has a thickness less than that of adjacent areas of the panels.

Likewise, a lid band extends along a periphery of the lid skirt 27. When in a closed position, the sealing band and lid band closely seat adjacent to one another ensuring a tight fit.

Release to an open lid position is achieved by finger pressure against the button to push same from capture within the aperture. This allows the lid to slide free and hingedly open.

Considerable plastic is utilized for the container body and lid. Accordingly, it is appropriate to re-use this article. A refill canister 34 holding towelettes is positioned within a cavity of the container body. Once all of the towelettes have been consumed, a new refill canister may be inserted into the container body. The refill canister is preferably manufactured as a thermoform object.

The refill canister is characterized by an open mouth defined by a ledge 36 outwardly projecting from the walls of the canister and surrounded by a guard skirt 38. The guard skirt is spacedly distant from walls of the canister yet sufficiently small to fit within the cavity of the container body.

Although the dispensing article can be used for storing a variety of dispensable materials, it is particularly preferred for dispensing towelettes. These materials are water-insoluble substrates impregnated with a cosmetic composition. Most preferred, the composition comprises lathering surfactants and skin conditioning agents.

The foregoing description and examples illustrate selected embodiments of the present invention. In light thereof variations and modifications will be suggested to one skilled in the art, all of which are within the spirit and purview of this invention.

What is claimed is:

1. A dispensing article comprising:

a container body having a floor panel, left and right side panels opposite one another arising from the floor panel, front and rear panels opposite one another arising from the floor panel, an open mouth defined by upper edges of the front, rear and side panels, a button flap unitarily formed with the front panel, and a button projecting outwardly from a surface of the button flap;

a lid having a roof panel hingedly joined to the container body, and a latch flap unitarily formed with and projecting downward from the roof panel;

wherein the latch flap includes an aperture shaped to receive the button therein, the latch and button flaps being more flexible than other sections of the lid and container panels.

2. The article according to claim 1 wherein the front panel and button flap have a relative thickness ranging from less than about 4:1 to more than about 1:1.

3. The article according to claim 1 wherein the lid and latch flap have relative wall thicknesses ranging from less than about 4:1 to more than about 1:1.

4. The article according to claim 1 wherein the button is oval shaped.

5. The article according to claim 1 wherein a sealing band is unitarily formed with panels of the container body, has a thickness about identical to the button flap, and extends along a periphery of the open mouth.

6. The article according to claim 1 wherein a lid band is unitarily formed with panels of the lid, has a thickness about identical to that of the latch flap, and extends along a periphery of the lid.

7. The article according to claim 1 wherein the container body and lid are formed of a polyolefin.

8. The article according to claim 7 wherein the polyolefin is polypropylene or polyethylene.

9. The article according to claim 1 wherein the lid is hingedly joined to the rear panel by two hinges.

10. The article according to claim 1 wherein the container body, lid and hinges are unitarily molded together.

11. The article according to claim 1 further comprising a refill canister inserted within a cavity of the container body.

12. The article according to claim 11 wherein the refill canister is produced as a thermoform plastic.

13. The article according to claim 11 wherein the refill canister comprises a guard skirt spacedly distant from walls of the canister.

14. A towelette dispensing article comprising:

a stack of towelettes;

a container body receiving the towelettes and having a floor panel, left and right side panels opposite one another arising from the floor panel, front and rear panels opposite one another arising from the floor panel, an open mouth defined by upper edges of the front, rear and side panels, a button flap unitarily formed with the front panel, and a button projecting outwardly from a surface of the button flap;

a lid having a roof panel hingedly joined to the container body, and a latch flap unitarily formed with and projecting downward from the roof panel;

wherein the latch flap includes an aperture shaped to receive the button therein, the latch and button flaps being more flexible than other sections of the lid and container panels.

15. A dispensing article comprising:

a container body having a floor panel, left and right side panels opposite one another arising from the floor panel, front and rear panels opposite one another arising from the floor panel, an open mouth defined by upper edges of the front, rear and side panels, a button flap unitarily formed with the front panel, and a button projecting outwardly from a surface of the button flap;

a Lid having a roof panel hingedly joined to the container body, and a latch flap unitarily formed with and projecting downward from the roof panel;

wherein the latch flap includes an aperture shaped to receive the button therein, the latch and button flaps being more flexible than other sections of the lid and container panels, the front panel and button flap having a relative thickness ranging from less than about 4:1 to more than about 1:1.

16. A dispensing article comprising:

a container body having a floor panel, left and right side panels opposite one another arising from the floor panel, front and rear panels opposite one another arising from the floor panel, an open mouth defined by upper edges of the front, rear and side panels, a button flap unitarily formed with the front panel, and a button projecting outwardly from a surface of the button flap;

a lid having a roof panel hingedly joined to the container body, and a latch flap unitarily formed with and projecting downward from the roof panel;

wherein the latch flap includes an aperture shaped to receive the button therein, the latch and button flaps being more flexible than other sections of the lid and container panels, the lid and latch flap having relative wall thicknesses ranging from less than about 4:1 to more than about 1:1.

* * * * *